US005526639A

United States Patent [19]

Gonzales

[11] Patent Number: 5,526,639

[45] Date of Patent: Jun. 18, 1996

[54] METHOD OF FORMING JEWELRY CHAINS

[76] Inventor: Virginia Gonzales, Avenida Ricardo, Palama 815, Lima 18, Peru

[21] Appl. No.: 407,719

[22] Filed: Mar. 21, 1995

[51] Int. Cl.[6] ..... B21L 15/00

[52] U.S. Cl. ..... 59/35.1; 59/29; 59/80

[58] Field of Search ..... 59/29, 35.1, 80

[56] References Cited

U.S. PATENT DOCUMENTS

| | | | |
|---|---|---|---|
| 2,371,141 | 3/1945 | Armbrust | 59/29 |
| 2,711,069 | 6/1955 | Armbrust | 59/35.1 |
| 2,821,064 | 1/1958 | Nelson | 59/29 |
| 5,125,225 | 6/1992 | Strobel | 59/35.1 |
| 5,285,625 | 2/1994 | Ofrat et al. | 59/35.1 |
| 5,412,935 | 5/1995 | Rozenwasser | 59/35.1 |

OTHER PUBLICATIONS

K & Y Diamond—Company Catalog.

Urgeles Diamond Tool Co., Inc.—Company Catalog.

*Primary Examiner*—David Jones

*Attorney, Agent, or Firm*—Galgano & Burke

[57] ABSTRACT

A jewelry rope chain, formed of either solid or hollow links, is provided with a novel finish comprising a smooth, continuously curved surface which reflects in a continuous fashion. Also disclosed are novel methods of forming jewelry rope chains which are designed to provide a highly reflective surface with minimal repositioning of the rope chain between cutting steps required.

11 Claims, 7 Drawing Sheets

METHOD OF FORMING JEWELRY CHAINS

The present invention relates to jewelry chains and, more particularly, to jewelry chains and methods of their manufacture which provide enhanced light reflectance.

BACKGROUND OF THE INVENTION

In the jewelry trade, rope chains are typically manufactured by hand or machine, by interlinking individual links, into the shape of a double helix. This procedure provides a rope appearance. The peripheral surface of the resulting rope chain comprises an undulating shape. Several different weaving techniques may be used and the resulting individual links can have different shapes. There might be a different number of links in the chains; e.g., three, four, five, etc. links might be inserted into one link. These chains might be solid, when each link is formed by a solid wire, or when it is stamped on a plate; or they might be hollow, when the links are formed by hollow tubes or tube sections. In the fine jewelry industry, these links are made with precious metals or alloys of precious metals.

The finish of the products is very important in precious metal jewelry. Based on the principle that a jewel must stand out and, therefore, "shine" i.e. reflect light brilliantly, jewelry manufacturers are constantly searching for new ways to improve the reflectance of their products.

If the chain is formed of links made with a solid wire and a circular cross-section, the cross-section of the rope chain will take the form shown in FIG. 1. If the links used to form the rope chain have square or rectangular cross-sections, whether in the form of square tubes or rectangular stamped plates, the cross-section of the rope chain may take the form shown in FIG. 2. Neither of the rope chains shown in FIGS. 1 or 2 have a smooth, continuously curved peripheral surface. The chain shown in FIG. 1 has a periphery made up of a series of small curved segments while the cross-section of FIG. 2 comprises an irregular surface with uneven, exposed edges. Those skilled in the art will appreciate that a chain such as that shown in FIG. 2 may have a tendency to become snagged on garments.

For several years, most rope chains had one of types of finish. A first type of finish was used for the solid chains as well as for the hollow chains. This type of finish preserved the original form of the links. These could be circular, oval, square, rectangular, etc. The shine of this chain type was achieved through various processes, such as: chemical cleaning, commonly known as bombing, or electrolytic processes, known as stripping; which could be combined with a tambouring, polishing or electrolytic silver plating processes. The shine quality of the resulting chain is a function of the alloy employed and of the uniformity of the wire or tube surface from which the link is made.

Rozenwasser's U.S. Pat. No. 5,303,540 teaches a method of obtaining a more intense shine on hollow rope chain. This method uses a link manufactured from a thin plate that has been planed or polished in a band that will form the external surface of the upper circumference of the link. The finished chain has the original shape of the links from which it is made, but more shine because the peripheral surface of the links purportedly obtains a better finish than earlier processes normally employed for the manufacturing of a hollow rope chain.

A second finishing method is the diamond cut process. The name of the "diamond cut" process and, therefore, the name of the chains so processed originates from the word diamond, because, the goal is that the resulting chain shines like a diamond. A diamond shines due to its cut and polished facets which reflect light with great intensity. The diamond cut process simulates the facets of a diamond by making facets in a regular finish chain. This type of finish is based on the principle that light will be reflected more by polished flat surfaces than other kind of surfaces. For that reason, surfaces are cut on the chain by using processes commonly employed in the jewelry industry, such as "ice-lathe to diamond" cutting processes performed with diamond milling machines, or, with extremely polished cutting tools. The result of said processes are extremely polished flat surfaces on the chain.

The diamond finish can De achieved with a different number of facets or cuts. However, the most common diamond cut has 4 or 8 facets as shown in FIGS. 3, 4 and 5.

The diamond cut process is used most commonly to diamond cut a solid like rope chain. In the case of a hollow link rope chain, a link can be deformed with a non-sharp tool to create flat surfaces simulating the facets of a diamond. Afterwards, a sharp tool may be employed to obtain a polished surface in each facet, so that the chain has a similar finish to a diamond cut solid chain. U.S. Pat. Nos. 5,125,225 and 5,129,220 by Strobel teach methods of placing facets in hollow link chains.

Other methods have been suggested for enhancing the finish of a jewelry chain or methods of obtaining improved finishes on such chains. For example, U.S. Pat. No. 4,716,750 of Tizzi discloses rotary swaging and annealing, repeated in sequence, to produce hollow articles with various tubular cross-sections. U.S. Pat. No. 4,754,535 of Valtiero discloses the use of ice as a packing material support for surface alteration of thin continuous stock. U.S. Pat. Nos. 2,424,924 of Chernow and 2,711,069 to Ambrust describe methods of producing ornamental facets on solid wire chain links through grinding operations. U.S. Pat. Nos. 3,083,002 of Lacey and 4,268,946 of Einseberg disclose the use of a solidifying material, such as ice, as a chuck to hold jewelry workpieces in place. Both of these patents are directed to cutting thin metal workpieces. The Eisenberg '946 patent particularly directed toward cutting tubular members.

U.S. Pat. Nos. 2,895,290 of Devonshire, 3,410,085 to Sheth, 4,679,391 to Tizzi and 4,682,467 to Waltmeyer disclose stamping impressions into solid chain links. The '391 patent is particularly directed toward jewelry.

U.S. Pat. No. 4,681,664 of Eberle discloses the altering or reinforcing of hollow thin walled jewelry articles by electroforming at stress points (such as at joints to increase their strength). U.S. Pat. No. 4,996,835 of Rozenwasser discloses the use of both solid and hollow links in jewelry rope chains, and German Patent No. 2,428,647 appears to disclose the use of a solidifying agent as a chuck to hold workpieces.

U.S. Pat. Nos. 5,125,225 and 5,129,220 by Strobel reveals the deformation of hollow annular links of a chain, in order to get flat surfaces on the chain that simulate the appearance of diamond cut solid chains.

U.S. Pat. No. 5,303,540 by Rozenwasser describes a process of manufacturing hollow links with the link's upper part polished. This results in a hollow chain finish where each link has a high shine on the surface of the external circumference.

While the previous disclosed methods of finishing jewelry rope chains have increased the reflectance of the peripheral surfaces of those chains, such peripheral surfaces are most often formed of a series of flat reflective surfaces, which only reflect light to the eyes of an observer if the particular reflective surface was positioned at a proper angle relative to the source of light. If the angle defined by the source of light, the reflective surface, and the eye of the observer was not correct then the observer would not observe light reflected brilliantly off one of the flat surfaces. For example, with a rope chain having flat facets such as those described above, if a particular facet is properly oriented for reflecting light directly from a source of light to a stationary observer, the observer would observe a brilliant reflection. However, if the rope chain was rotated slowly the observer would not observe a brilliant reflection until the adjacent facet was properly oriented between the source of light and the observer's eye. Therefore, it will be appreciated that the use of flat faceted reflective surfaces does not provide a "continuous" reflectance.

It would therefore be desirable to increase the duration of the pleasant high reflectance observed by a person viewing a jewelry rope chain.

It would also be desirable to provide a method for forming jewelry rope chains having continuous reflectance, whether formed of solid or hollow links.

SUMMARY OF THE INVENTION

One aspect of the present invention comprises a novel jewelry rope chain which advantageously has more continuous reflectance than previously disclosed rope chains. The novel chains of the present invention can be formed utilizing either solid or hollow links of a wide assortment of original shapes and either by hand or an automated weaving process. Another aspect of the present invention comprises a novel method of making the novel chain of the present invention.

One preferred rope chain of the present invention comprises a chain having a peripheral surface with a continuously curved surface. This embodiment of the present invention eliminates the undulations in the peripheral edges of the chain. This embodiment of the present invention may be obtained with chains having either solid or hollow links. This aspect of the present invention provides a more even intensity in the manner in which light is reflected from the rope chain. Particularly, light is reflected to an observer from all portions of the chain's perimeter, and not only from properly oriented faceted areas as in conventional diamond cut finishes. As stated above, those skilled in the art will appreciate that a diamond cut chain will only reflect light when one or more facets are properly oriented relative to the source of light and the observer's eye. The chains of the present invention advantageously do not rely upon the particular orientation of the chain in order to reflect light to the observer.

The continuously curved peripheral surface of this aspect of the present invention also advantageously eliminates sharp edges common in diamond cut chains which may damage garments.

The methods of the present invention described herein also provide a significant time and cost reduction since specially designed tools allow treating the entire peripheral surface of the chain while rearranging the chain only twice. This offers a significant time and cost advantage over the previously described conventional diamond cut process which requires a cutting tool to be reoriented relative to the chain for each facet. Thus, for a diamond cut cutting having eight facets, it was previously necessary to put the chain in the machine eight times audio repeat the cutting process eight different times. By reducing the number of steps required, the processes of the present invention reduce the risk of human error and costs involved therewith.

DETAILED DESCRIPTION

Figure 1:
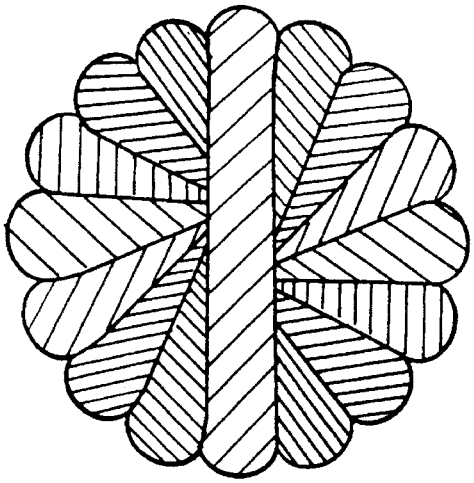
FIG. 1 (PRIOR ART)
FIG. 1 is a cross-sectional view of a conventional rope chain of the prior art made with round wire links.
Figure 2:
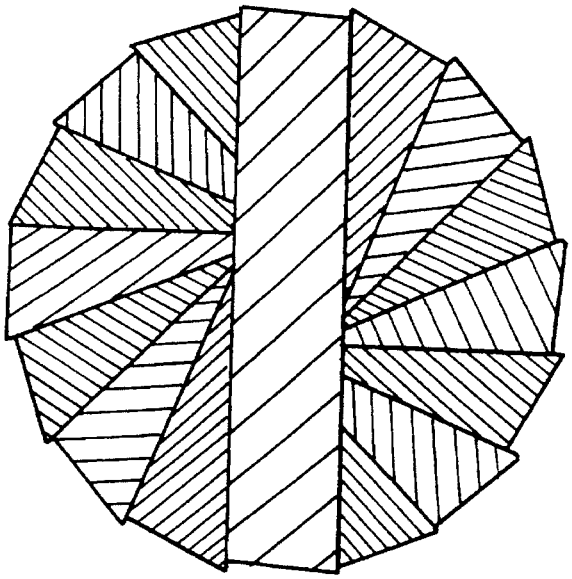
FIG. 2 (PRIOR ART)
FIG. 2 is a cross-sectional view of a conventional rope chain of the prior art made with square wire links.
Figure 3:
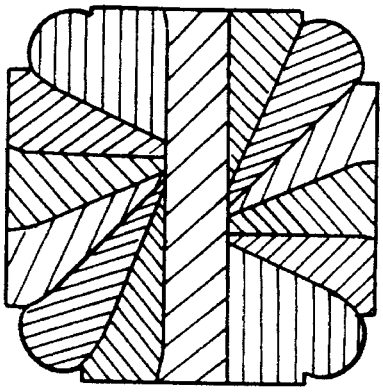
FIG. 3 (PRIOR ART)
FIG. 3 is a cross-sectional view of a conventional rope chain formed with round wire links and having four facets cut therein.
Figure 4:
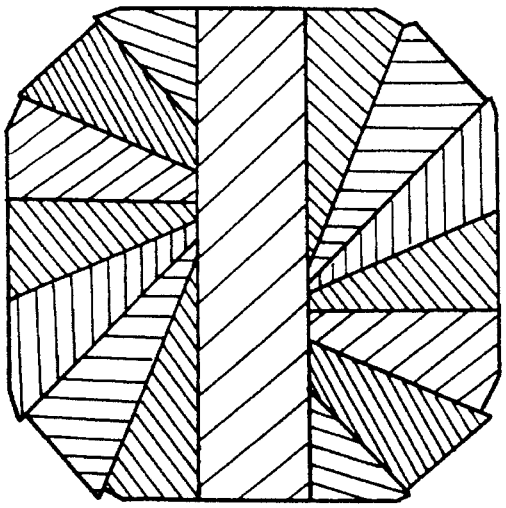
FIG. 4 (PRIOR ART)
FIG. 4 is a cross-sectional view of a conventional rope chain of the prior art made with square wire links and having four facets cut therein with a diamond cut process.
Figure 5:
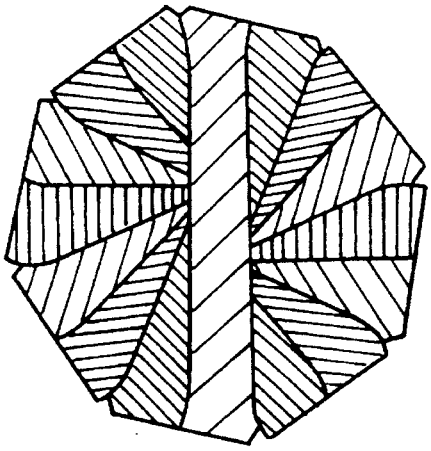
FIG. 5 (PRIOR ART)
FIG. 5 is a cross-sectional view of a conventional rope chain of the prior art made with round wire links and having eight facets cut therein with a diamond cutting process.
Figure 7:
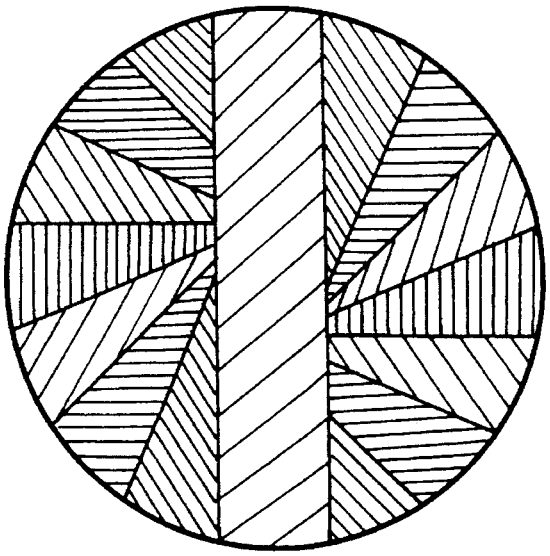
FIG. 7 is a cross-sectional view of a rope chain made from square wire links having the preferred finish of the present invention.
Figure 6:
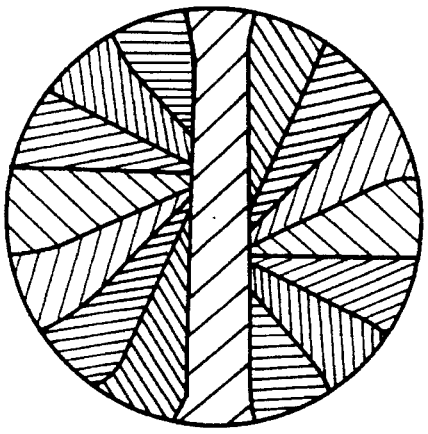
FIG. 6 is a cross-sectional view of a rope chain made from round wire links and having a preferred finish of the present invention.
Figure 8A:
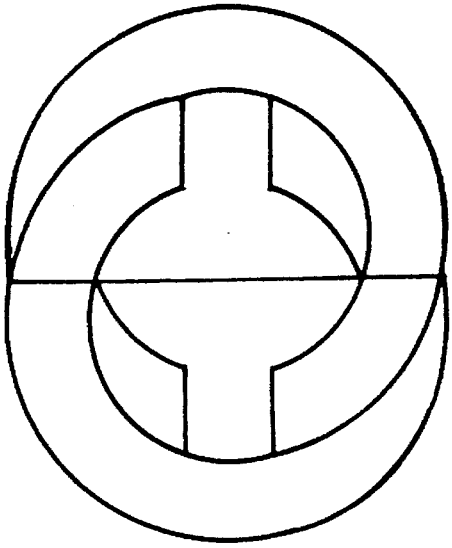
FIGS. 8A and 8B illustrate two solid links that may be used as building blocks to form a rope chain that may be finished using a method of the present invention.
Figure 8B:
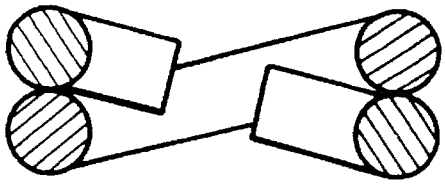
Figure 9A:
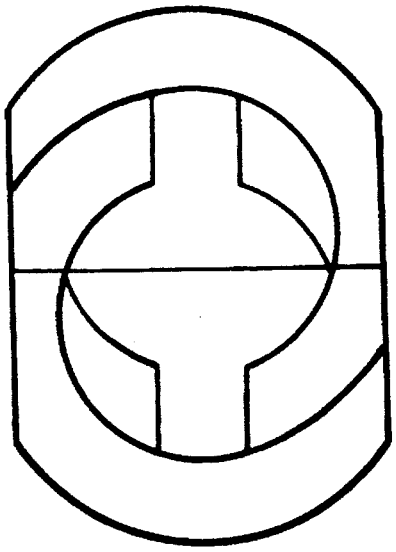
FIGS. 9A and 9B illustrate the links of a chain of the present invention after the chain has been finished utilizing a process of the present invention.
Figure 9B:
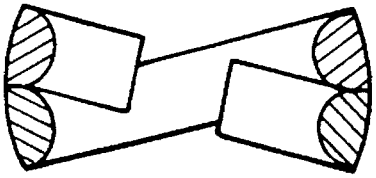

One aspect of the present invention provides a jewelry rope chain having a novel finish wherein the outer periphery of the rope chain is provided with a continuously curved surface which reflects light directed on that surface from any angle. FIGS. 6 and 7 are cross-sectional views of rope chains having the preferred continuously curved surface of the present invention formed from round wire link and square wire links, respectively. The smooth peripheral surface is readily distinguished from the undulating and uneven surfaces of the prior art rope chains illustrated in FIGS. 1–5. For purposes of illustration, FIGS. 8A and 8B are top and cross-sectional views, respectively, of two links of a rope chain wherein these are round wire links. FIGS. 9A and 9B illustrate the links of FIGS. 8A and 8B after the chain has been formed according to the preferred method of the present invention to provide a smooth continuous surface.

These figures are for illustrative purposes only and are not intended to suggest that a chain of the present invention will be finished two links at a time.

Figure 10A:
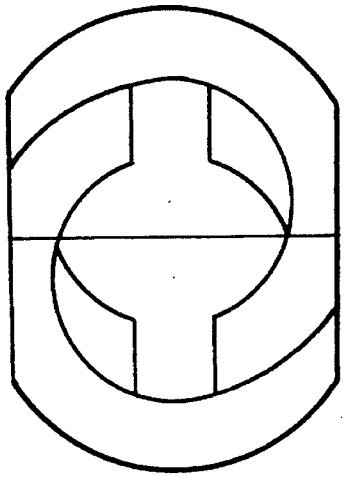
FIGS. 10A, 10B and 10C illustrate two hollow links of a rope chain which have been finished utilizing a process of the present invention.
Figure 10B:
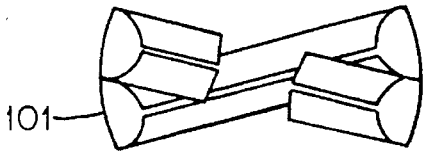
Figure 10C:
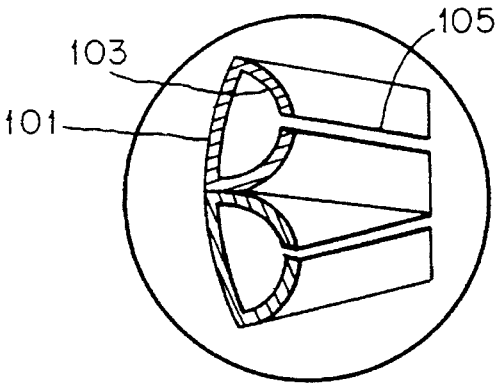

FIGS. 10A, 10B and 10C are top, cross-sectional and enlarged cross-sectional views, respectively, of two hollow links of a rope chain which have been finished according to a method of the present invention. These hollow links comprise an outer peripheral surface 101, a hollow interior defined by inner walls 103 and a seam 105. The outer peripheral surface 101 is shaped into a continuous curve and therefore will reflect light continuously to the eye of an observer even as the relative position of the observer or the angular orientation of the chain shifts.

Figure 11:
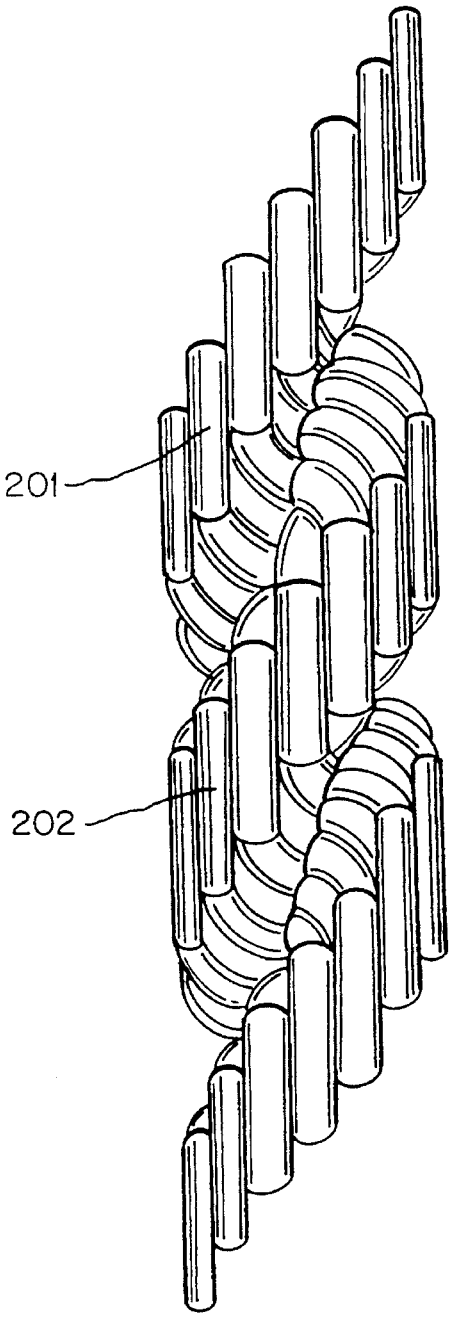
FIG. 11 is a perspective view of a portion of a rope chain of the present invention.

FIG. 11 is a partial perspective view of a jewelry rope chain having the preferred finish of the present invention. This chain is generally configured as a double helix wherein two continuously curved peripheral surfaces 201 and 202 spiral continuously around the periphery of the rope chain.

According to a preferred method of providing a reflective finish of the present invention to a jewelry rope chain, this reflective finish can advantageously be accomplished by positioning the chain on the drum of a lathe only twice. Furthermore, the preferred method of providing a reflective finish according to the present invention can be accomplished with simple modifications to previously known diamond cutting methods.

Figure 14:
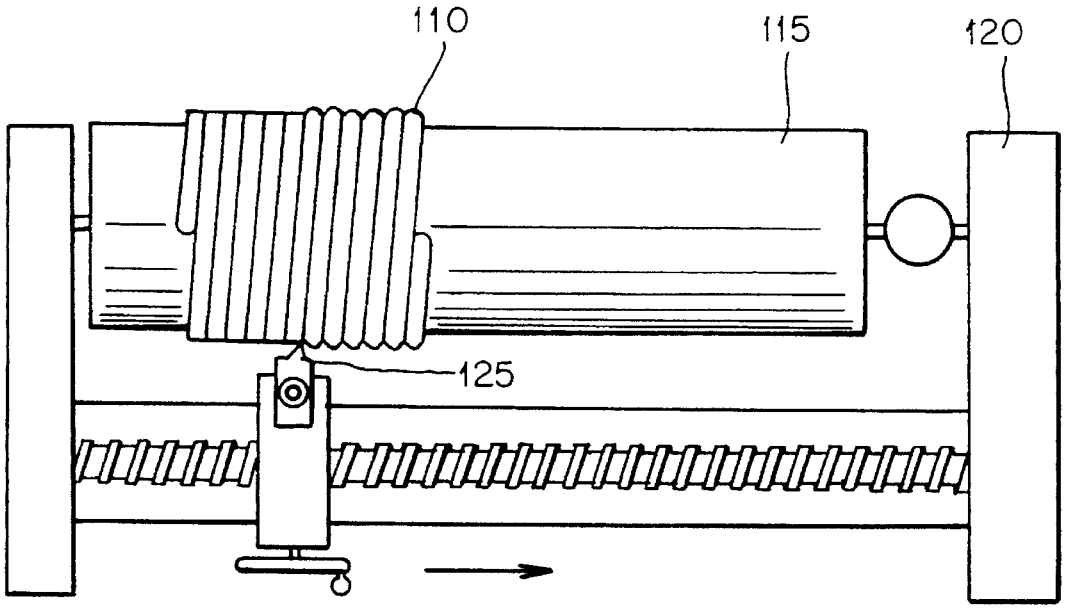
FIG. 14 is an illustration of ice lathe used with a conventional diamond cutting process for jewelry rope chains.
Figure 15:
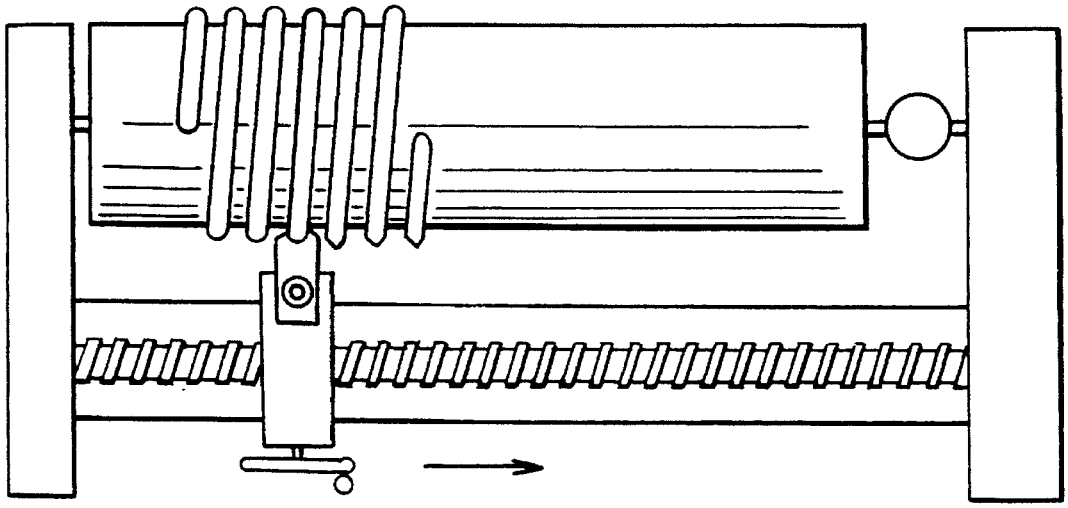
FIG. 15 is an illustration of an ice lathe used with one embodiment of the present invention.

Those skilled in the art will appreciate that as illustrated in FIG. 14 when an ice-lathe is used to diamond cut rope chains, the chain 110 to be diamond cut is snugly wrapped in continuous fashion about a drum. Each turn of the chain abuts the previous roll around an empty steel drum 115 that is installed between the points of the universal lathe 120. The chain ends are fastened to the drum's end with a wire, e.g. copper wire (not shown). While the drum rotates, driven by a rotary hook, located at one of the drum's ends, a cooling liquid, such as Glycol at a temperature between minus 10 to minus 20 degrees celsius, enters the drum. This cooling fluid circulates permanently between a refrigeration unit and the drum. As the drum's temperature gets lower and the drum has the chain securely attached thereto, the chain is sprayed with cold water which freezes when it touches the drum or the chain, covering the drum completely with ice.

After icing, a very sharp and polished cutting tool 125 moves slowly along the lathe, cutting a section of the upper part of the links that are further away from the drum's axis where the chain is wrapped; this way, flat surfaces, i.e. facets, are created on the periphery of the chain.

In the diamond process, the movement of the cutting tool 125 along the chain 110 is made slowly in order to achieve a very polished finish without visible lines. This cutting operation is typically carried out while the lathe rotates at 200–300 rpm.

To achieve the desired surface, several rounds with incremental cuts of 0.05–0.075 mm. in depth are preferably carried out. When the desired cut has been obtained, the circulation of the cooling liquid is stopped and hot water is sprayed over the drum. The ice melts and the chain is removed. This operation is repeated as many times as facets the chain will have. The position in the drum must be changed cut a new facet.

The process of the present invention may utilize the same equipment and process, with the following modifications:

Drum Preparation: A guide groove with helical shape is made in the drum with a curve cutting tool capable of cutting steel. The internal radius of the helical groove must be properly dimensioned to receive chains of the diameters to be processed, for example two to five rounds per inch. This drum preparation is required only once and this drum can be used every time the finish is desired.

The lathe is initially rotated slowly, in the opposite direction to the cut's direction, and the chain is wrapped snugly around the drum, locating the chain in the channel previously made in the drum.

Figure 12A:
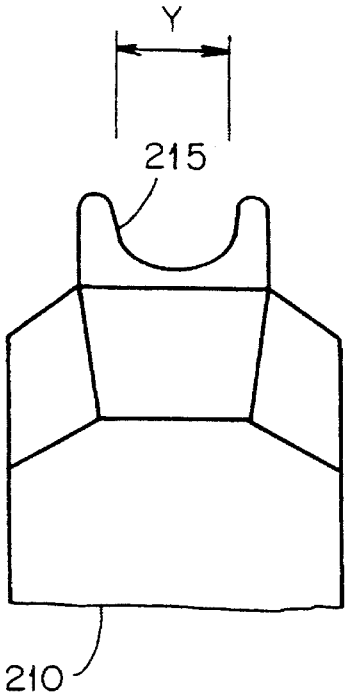
FIGS. 12A and 12B are front and side views respectively of a guiding tool used with a process of the present invention.
Figure 12B:
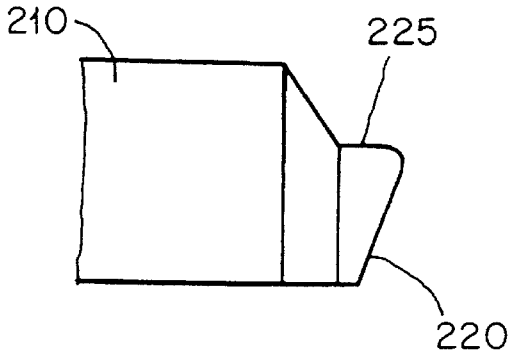

Guiding Tool Step: The present invention also preferably utilizes a guiding tool in order to facilitate the proper positioning of the rope chain in the groove of the rotating drum. One such guiding tool is illustrated in FIG. 12A and 12B wherein a base 210 is connected to a generally concave guide surface 215 having a forward end 220 and a trailing end 225, best shown in FIG. 12B. The illustrated guiding tool is provided with non-sharpened edges since the guiding tool is merely designed to insure the proper positioning of the rope chain in the drum channel and not to effect the finish of the chain. The guiding tool is used by placing the guiding tool in the carriage and centering the guide tool relative to the chain in one of the drum's ends. The tool is positioned close to the drum, so that the chain is placed in the middle of the tool. When the chain is in position, by coordinating the carriage movement with the angle of the groove for the drum, the lathe is started up at a slow speed. In this manner, the guide tool will insure proper positioning of the chain within the drum's channel and indicate any existing discrepancy in the chain placement with respect to the carriage's movement. From the present description, it will be appreciated that it is important to the proper finishing of a rope chain by the methods of the present invention that the movement of the cutting tool be properly coordinated with the movement of the rope chain on the drum.

Cutting Step: The freezing process is preferably performed and then the tool is centered with respect to the beginning of the chain at the drum's end and is positioned to touch the chain slightly on passing. The carriage movement is coordinated according to the displacement to be used and the lathe is started up with in cut rotating direction at a speed between 200 and 300 rpm.

when the carriage has reached the end of the chain it is stopped and the cut depth is preferably incremented about 0.05–0.075 mm. for the return movement direction. This operation is most preferably repeated until the undulations and unevennesses between the links are eliminated providing an even continuously curved, peripheral surface to the chain.

The chain can then be defrosted and repositioned so that the finished chain side faces the drum (180 degrees with respect to its previous position). The guiding, freezing and cutting steps are repeated so that the remaining 180 degrees of the chain will receive the desired finish. After defrosting and cleaning the chain, the chain has a peripheral finish with a mirror-like surface.

According to an alternative preferred method of the present invention, four identical cutting tools are positioned at spaced locations around a finishing drum. Each cutting tool is positioned to provide a cut at a different depth so that a rope chain will encounter successively deeper cuts as the chain proceeds from the initial cutting tool to the fourth tool. In this manner, the fourth cutting tool may create the desired finish in 180 degrees of the chain perimeter.

The present invention and tools used in the method described above with reference to finishing a solid chain may also be used to provide the desired finish to a chain having hollow links. When it is desired to perform the patented process on hollow links, after the freezing step described above, a cutting tool is still utilized however the cutting tool is oriented so that the cutting edge is angled in the same direction as the movement of the chain relative to that edge, i.e., so that the sharpened edge does not cut into the chain. In this manner, the hardened cutting edge will serve to deform the hollow links of the rope chain instead of cutting off the undesired previous metal. Those skilled in the art will appreciate that the actual wall thickness of hollow links is very minimal and that such hollow links cannot withstand much removal of metal before sustaining damage. As in the process described above, this operation is repeated until the undulations and unevenness between the links are eliminated by the deformation of the hollow links and a rope chain having an even, peripheral surface is obtained. As a final finishing step, the cutting tool is reorientated with respect to the drum rotation in order to actually cut metal from the hollow link chain. In this manner, and with proper depth positioning of the cutting tool, approximately 0.01–0.02 mm will be cut in 180 degrees of the chain to obtain a mirror-like surface similar to the solid chain's surface. The same operation is repeated on the opposite side of the chain to achieve the desired finish around the entire chain.

A diamond milling machine may also be used to obtain the chain finish. In order to achieve this, the process described above for the solid chain in this machine type is preferably used. The difference is that the chain must pass through the machine twice. At the first opportunity, the cutting tools in the tool carrier disc will be rotated in the opposite direction to the cut direction, until the desired even surface is achieved. After repeated deformations of the hollow links and a final pass, the tools are rotated in the cut direction to create the desired mirror surface.

Figure 13A:
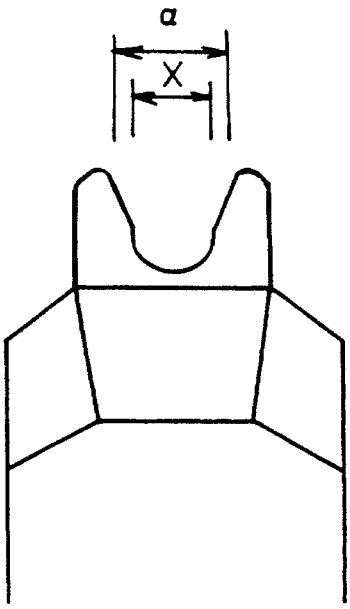
FIGS. 13A and 13B are front and side views respectively of a cutting tool utilized with a method of the present invention.
Figure 13B:
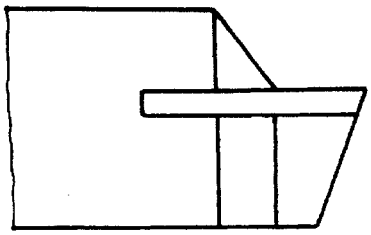
Figure 16:
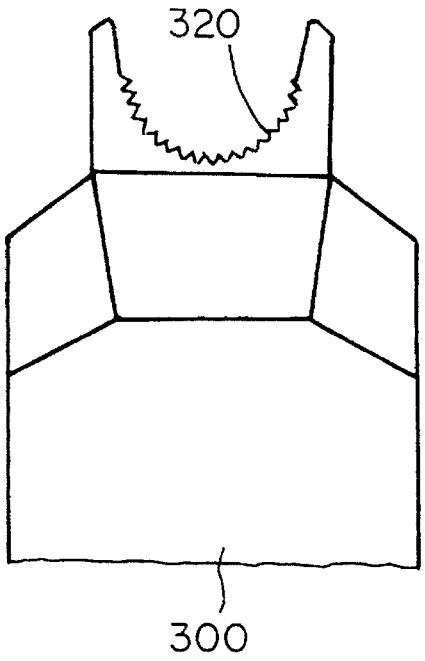
FIG. 16, 17, 18 and 19 illustrate alternative cutting tools which may be utilized in accordance with alternative methods of the present invention.
Figure 17:
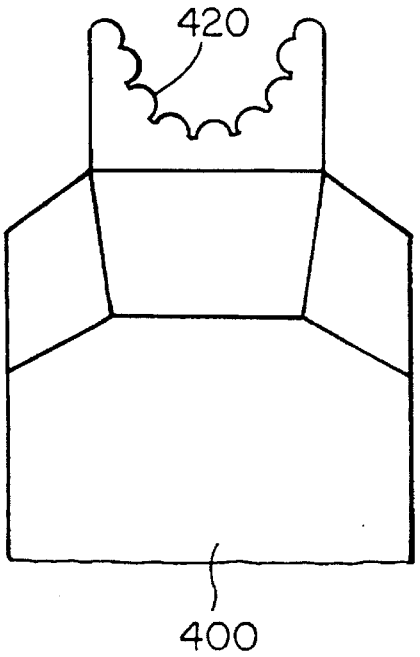

The processes of the present invention can also be employed to give other finishes to a rope chain, that would not be possible by other traditional processes. For example, a striped finish posterior can be provided to the smooth, continuous finish by using either of the tools shown in FIGS. 16 or 17. Cutting tool 300 comprises a concave, sharpened cutting edge 320 which is similar to cutting edge 20 of the cutting tool shown in FIG. 13 with the exception of having a plurality of sharpened points so that cutting edge 320 is not perfectly smooth. In a somewhat similar fashion, cutting tool 400 comprises a concave cutting surface 420 comprising a plurality of raised protrusions for creating a different effect.

Figure 18:
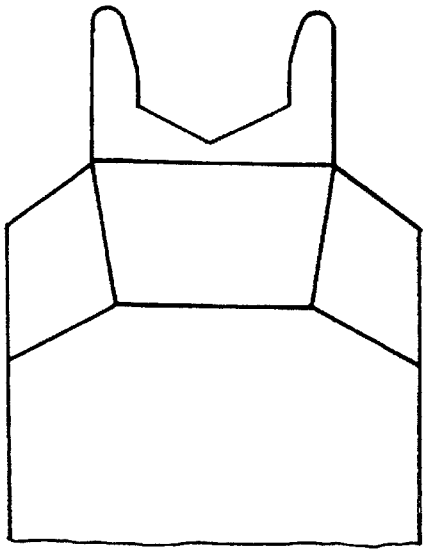
Figure 19:
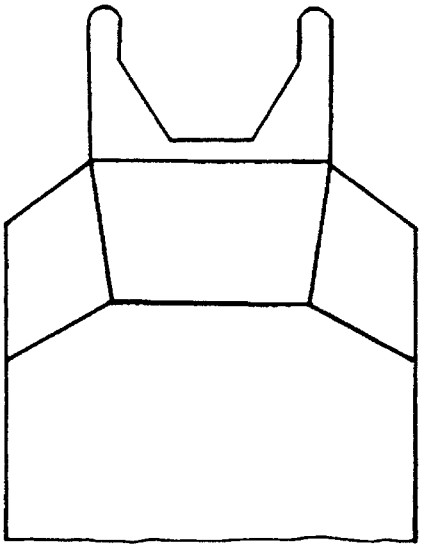

The advantageous aspects of the methods disclosed herein may also be used to provide a finish similar to the faceted rope chains described above which have previously been obtained using a cut for each facet. FIGS. 18 and 19 illustrate examples of cutting tools which may be utilized to provide a six-faceted chain and an eight-faceted chain, respectively while only requiring two repositioning steps during cutting operations. From the present description, those skilled in the art will appreciate that the present invention greatly reduces the time and cost of a cutting operation by reducing the number of times that a chain must be repositioned prior to cutting. It will also be appreciated that the present invention provides novel methods of finishing jewelry rope chains wherein a cutting tool having a substantially concave surface is moved relative to the jewelry chain in order to finish the chain by either deforming or cutting the outer periphery of the chain. The concave portion of the cutting tool preferably surrounds at least 120° of the rope chain and, most preferably, surrounds about 180° of the rope chain with a sharpened cutting edge in order to minimize the number of repositioning steps required during a finishing operation.

What is claimed is:

1. A method of providing a reflective finish to a jewelry rope chain comprising a plurality of interconnected links which form an original periphery comprising the steps of:

providing a cutting tool comprising a concave cutting edge which extends about 180° around said original periphery formed by said plurality of interconnected links of said chain;

positioning said cutting tool in engagement with a plurality of said links of said chain;

moving said chain relative to said cutting tool thereby simultaneously removing a portion of the peripheral surface of a plurality of said links of said chain; and connecting said chain to a rotatable drum prior to moving said chain relative to said cutting tool.

2. A method of providing a reflective finish to a jewelry chain according to claim 1 further comprising the step of providing said drum with a spiral groove adapted to receive said chain prior to connecting said chain to said drum.

3. A method of providing a reflective finish to a jewelry chain according to claim 2 further comprising the steps of:

providing means for positioning said chain in said spiral groove; and moving said positioning means relative to said chain thereby positioning said chain in said spiral groove.

4. A method of providing a reflective finish to a jewelry chain according to claim 1 further comprising the steps of:

changing the positioning of said chain relative to said drum; and moving said chain relative to said cutting tool again thereby cutting off another portion of the peripheral surface of said chain.

5. A method of providing a reflective finish to a jewelry rope chain comprising a plurality of interconnected links which form an original periphery comprising the steps of:

providing a cutting tool comprising a continuously curved concave cutting edge which extends about 180° around said original periphery formed by said plurality of interconnected links of said chain;

positioning said cutting tool in engagement with a plurality of said links of said chain; and moving said chain relative to said cutting tool thereby simultaneously removing a portion of the peripheral surface of a plurality of said links of said chain.

6. A method of providing a reflective finish to a jewelry chain according to claim 1 wherein said concave cutting edge comprises a serrated portion.

7. A method of providing a reflective finish to a jewelry rope chain according to claim 14 wherein said step of providing a cutting tool comprising a concave cutting edge comprises providing a cutting tool comprising a cutting edge which comprises a first portion which is continuously curved and a second portion which is substantially straight.

8. A method of providing a reflective finish to a jewelry rope chain according to claim 1 wherein said step of providing a cutting tool comprising a concave cutting edge comprises:

providing a cutting tool comprising a first portion which is continuously curved to define an arc of a substantially constant radius about a center point and a second portion which tapers outwardly away from said center point.

9. A method of providing a reflective finish to a jewelry rope chain comprising a plurality of interconnected links which form an original periphery comprising the steps of:

providing a cutting tool comprising a concave cutting edge having a first portion comprising a continuously curved concave opening facing a first direction and a second portion which extends away from said opening;

positioning said cutting tool in engagement with a plurality of said links of said chain; and moving said chain relative to said cutting tool thereby simultaneously removing a portion of the peripheral surface of a plurality of said links of said chain.

10. A method of providing a reflective finish to a jewelry rope chain according to claim 9 wherein said step of providing a cutting tool comprises:

providing a cutting tool having a second portion which extends at least partially in said first direction from said opening.

11. A method of providing a reflective finish to a jewelry rope chain according to claim 9 wherein said step of providing a cutting tool comprises:

providing a cutting tool comprising a first portion comprising a concave opening facing a first direction and a second portion which extends from said opening at least partially in said first direction and outwardly from said opening.

* * * * *